US005471716A

United States Patent [19]

Takahashi

[11] Patent Number: 5,471,716

[45] Date of Patent: Dec. 5, 1995

[54] BUCKLE

[75] Inventor: Yoshinobu Takahashi, Uozu, Japan

[73] Assignee: Yoshida Kogyo K.K., Tokyo, Japan

[21] Appl. No.: 261,414

[22] Filed: Jun. 17, 1994

[30] Foreign Application Priority Data

Jun. 18, 1993 [JP] Japan ..... 5-38119 U
Jun. 18, 1993 [JP] Japan ..... 5-172264

[51] Int. Cl.[6] ..... A44B 11/00

[52] U.S. Cl. ..... 24/615; 24/590; 24/597; 24/625

[58] Field of Search ..... 24/615, 616, 575, 24/625, 682, 597, 590, 686, 598.5, 905, 600.9, 601.1, 265 H, 662, 633, 671, 614, 68 CD

[56] References Cited

U.S. PATENT DOCUMENTS

| | | | |
|---|---|---|---|
| 175,334 | 3/1876 | Carson | 24/590 |
| 189,258 | 4/1877 | Pope | 24/590 |
| 1,764,044 | 6/1930 | Hoffman | 24/597 |
| 5,127,137 | 7/1992 | Krauss | 24/265 H |
| 5,148,582 | 9/1992 | Dennis, Jr. . | |
| 5,243,741 | 9/1993 | Fudaki et al. . | |
| 5,263,234 | 11/1993 | Fudaki . | |
| 5,274,887 | 1/1994 | Fudaki . | |
| 5,293,673 | 3/1994 | Murai . | |

FOREIGN PATENT DOCUMENTS

| | | |
|---|---|---|
| 0099577 | 2/1984 | European Pat. Off. . |
| 0535606 | 4/1993 | European Pat. Off. . |
| 0575078 | 12/1993 | European Pat. Off. . |
| 2635652 | 3/1990 | France . |
| 9102723 U | 7/1991 | Germany . |
| 794905 | 9/1990 | Japan . |
| 5-91905 | 4/1993 | Japan . |

*Primary Examiner*—Victor N. Sakran
*Attorney, Agent, or Firm*—Hill, Steadman & Simpson

[57] ABSTRACT

A buckle having a male coupling member for attaching to one article and a female coupling member for attaching to another article. The male coupling member includes an article-attaching frame having a pair of side bars, an article-attaching bar joined at their opposed ends to the respective upper ends of the side bars and a proximal bar joined at its opposed ends to the respective lower ends so as to rotate on its own axis, and a locking member including a joint portion integrally mounted on the upper end of the locking member and mounted on the proximal bar so as to rotate on the axis of the locking member which is substantially normal to the axis of the proximal bar. The female coupling member includes a housing body and an article-attaching portion provided on the housing body and attachable to the other article; and means for locking the locking bar into the housing body so as to rotate on the housing body around the axis which is perpendicular to the plane of the buckle.

7 Claims, 9 Drawing Sheets

BUCKLE

BACKGROUND OF THE INVENTION

1. Field of the Invention

The present invention relates generally to a buckle used with belts, garments, baggage's etc., and more particularly to a buckle comprising a pair of male and female coupling members, the male coupling member attached to one part of such an article and the female coupling member attached to the other part so that the coupling of the male and female coupling members makes the both parts connected to each other.

2. Description of the Prior Art

A typical example of a buckle described above is disclosed in Japanese Patent Laid-open Publication No. 5-91905. The disclosed plastic buckle is comprised of a pair of male and female coupling members, the male coupling member being insertable into the female coupling member. The female coupling member is composed of a pair of parallel spaced upper and lower plates defining there between a chamber. The upper plate has a circular through aperture formed there through. The lower plate has its central area cut away to provide a resilient engaging tongue. The resilient engaging tongue extends from the lower plate and normally projects inside the chamber. The male coupling member is comprised of a peripheral body having a central hole and a substantially circular button extending from the peripheral body so as to substantially fill up the central hole. The peripheral body has a locking step formed on the distal end thereof. When the male coupling member is inserted into the female coupling member, the locking step of the male coupling member comes into locking engagement with the tip of the locking tongue, and the circular button, under its own bias, comes into locking engagement with the circular aperture. To uncouple the male coupling member from the female coupling member, the circular button exposed in the circular aperture is simply depressed. The circular button, in turn, presses down the resilient engaging tongue against its resiliency, thereby bringing the resilient engaging tongue out of locking engagement with the locking step of the male coupling member. Now that the locking step of the male coupling member comes out of locking engagement with the resilient engaging tongue of the female member, the male coupling member can be pulled out of the chamber of the female coupling member.

Another example of a buckle of this type is disclosed in Japanese Design Registration No. 794905. This conventional buckle, likewise, is comprised of a male coupling member and a female coupling member for coupling engagement with the male coupling member. The male coupling member is comprised of an insert plate and a resilient locking tongue cut in the insert plate and projecting slantly upward by its own resiliency. The resilient tongue has a circular button formed thereon. The female coupling member is comprised of a pair of upper and lower plates defining therebetween a chamber for receiving the insert plate of the male coupling member. The upper plate of the female coupling member has a circular aperture formed centrally. To couple the male coupling member and the female coupling member, the insert plate of the male coupling member is inserted into the chamber of the female coupling member. The insert member is inserted into the chamber against the bias of the resilient tongue, until the circular button reaches the central circular aperture. At this moment, the circular button enters the central circular aperture of the female coupling member by the resiliency of the resilient tongue. To uncouple the male coupling member from the female coupling member, the circular button is depressed out of engagement with the circular aperture. Now that the circular button is no longer engaged with the circular aperture of the female coupling member, the insert plate of the male coupling member may be released from the chamber of the female coupling member.

These conventional buckles, however, suffer drawbacks.

When the first buckle is in coupled disposition, the male coupling member can rotate relative to the female coupling member in the plane of the buckle. However, the male coupling member and the female coupling member cannot rotate relative to each other in other directions, especially, perpendicularly to the plane of the buckle. Such a buckle is oftentimes used with a belt. When the belt having the buckle thereon is wrapped around the body of a wearer, the buckle is subjected to stresses exerted in various directions through the belt. If subjected to stresses tending to act in the plane of the buckle, the buckle can absorb the stresses by the male coupling member rotating relative to the female coupling member in the plane of the buckle. But, if subjected to stresses acting perpendicularly to the plane of the buckle, the buckle cannot absorb the stresses because the male and female coupling members cannot rotate relative to each other perpendicularly to the plane of the buckle. This will cause the wearer to feel uncomfortable whilst wearing the belt.

The second conventional buckle also has drawbacks. In order to facilitate coupling of the circular button with the circular aperture, the circular aperture of the female coupling member must be made greater in diameter than the circular button of the male coupling member. Since the curvature of the circular aperture differs from that of the circular button, the circular button contacts the circular aperture only at a point, when the former is coupled with the latter. As a result, the stresses tending to separate the male coupling member from the female coupling member concentrate upon that contact point, which is likely to cause the male coupling member to accidentally detach from the female coupling member or to deform that region of the circular button or circular aperture and even damage the buckle as a whole.

SUMMARY OF THE INVENTION

With the foregoing difficulties in view, it is therefore an object of the present invention to provide a buckle wherein, in coupled disposition, a male coupling member and a female coupling member are freely rotatable relative each other in various directions so that the buckle can fit variant shapes of a wearer body and variable movement of the wearer, so that the wearer feels fit and conformable with the buckle.

It is another object of the present invention to provide a buckle wherein a male coupling member and a female coupling member can be firmly coupled with each other and well prevented from accidental detachment, deformation or damage.

It is still another object of the present invention to provide a buckle which is sturdy and simple in construction.

It is still another object of the present invention to provide a buckle wherein a male coupling member and a female coupling member can be coupled easily and smoothly.

According to one aspect of the present invention, there is provided a buckle comprising a male coupling member attached to one article; a female coupling member attached to another article; the male coupling member including an article-attaching frame having a pair of side bars, an article-attaching bar joined to the side bars and a proximal bar joined to the respective lower ends of the side bars so as to rotate on its own axis and a locking member including a joint portion integrally mounted on the upper end thereof and mounted on the proximal bar so as to rotate on the axis of the locking member which is substantially perpendicular to the axis of the proximal bar; the female coupling member including a housing body and an article-attaching portion provided on the housing body and adapted to be attached to the other article, the housing body comprising a pair of upper and lower plates joined to each other to define a chamber therebetween, respective front edges of the upper and lower plates defining a front opening therebetween which communicate with the chamber; and means for locking the locking member into the housing body so as to rotate on the housing body around the axis which is perpendicular to the plane of the buckle.

According to another aspect of the present invention, there is provided a buckle comprising a male coupling member attached to one article and a female coupling member attached to another article, the male coupling member including an article-attaching frame and a locking member including a locking bar, a joint portion integrally mounted on the upper end of the locking bar and mounted on the article-attaching frame so as to rotate on the axis of the locking member and a locking button mounted on a lower end of the locking bar, the locking button having a convex edge formed closer to the joint portion, the female member including a housing body and an article-attaching portion provided on the housing body and attached to the other article, the housing body comprising a pair of upper and lower plates joined to each other to define a chamber therebetween, respective front edges of the upper and lower plates defining a front opening there between which communicate with the chamber, the upper plate having an aperture formed therein, the aperture having a concave indentation formed in that part of its periphery which is closer to the opening, the concave indentation being equal in curvature to the convex edge of the locking button, upon insertion of the locking member into the housing body, the convex edge of the locking button coming into locking engagement with the concave indentation of the locking aperture.

Many other advantages and features of the present invention will become manifest to those versed in the art upon making reference to the detailed description and the accompanying sheets of drawings in which preferred structural embodiments incorporating the principles of the present invention are shown by way of illustrative examples.

DETAILED DESCRIPTION

Figure 1:
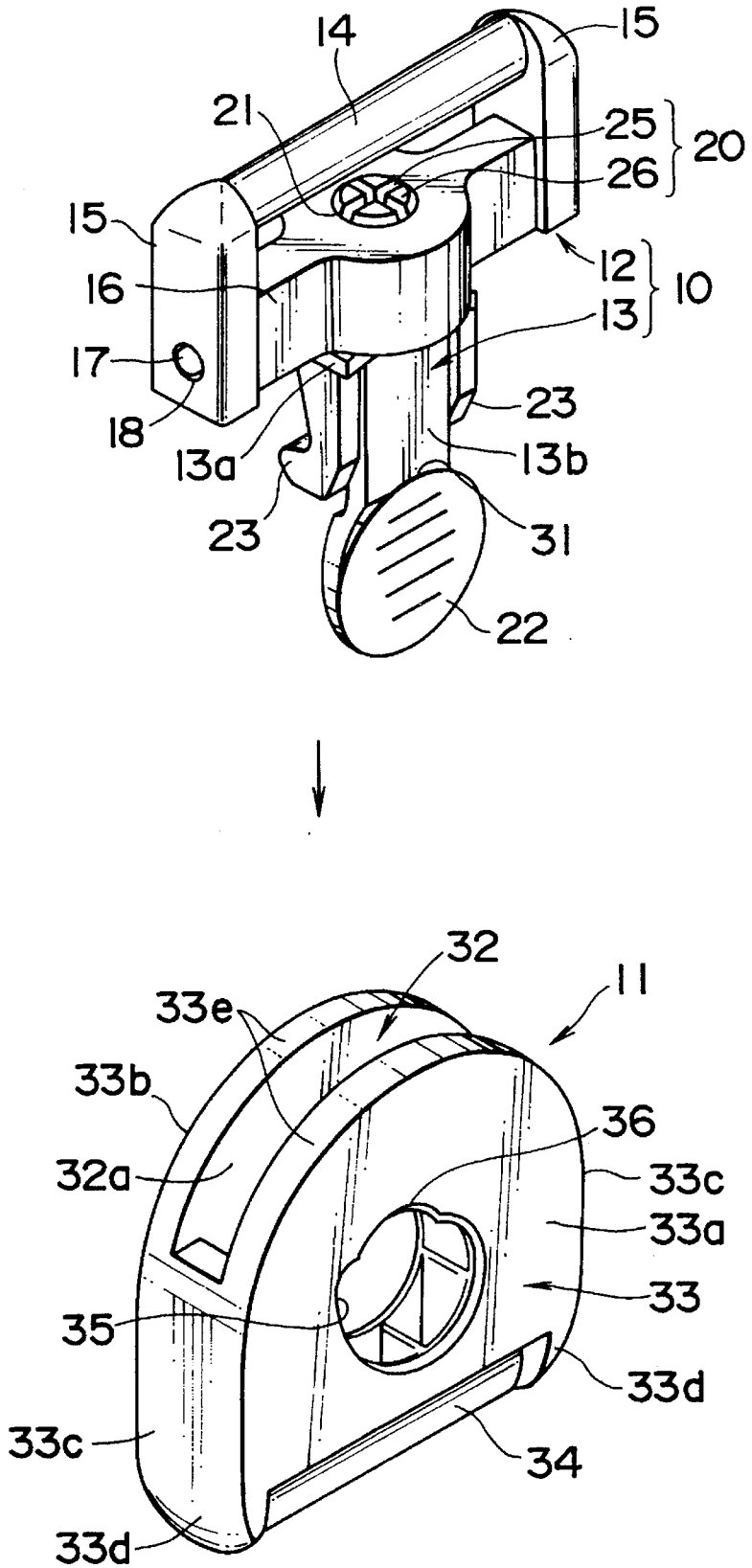
FIG. 1 is a exploded perspective view of a buckle according to the first embodiment of the present invention.

Description is now made to some preferred embodiments of the present invention in conjunction with the drawings appended hereto. First of all, FIGS. 1 through 4 show a buckle according to the first embodiment of the present invention. As better shown in FIG. 1, the buckle is broadly comprised of a male coupling member 10 and a female coupling member 11 both made of plastics. As shown in FIG. 1, the male coupling member 10 is attached to for example one end 1 of a belt and the female coupling member 11 is attached to the other end 2 of the belt, and the male coupling member 10 comes into coupling engagement with the female coupling member 11 for connecting the opposite ends 1, 2 of the belt, as hereinafter set forth in detail.

Figure 3:
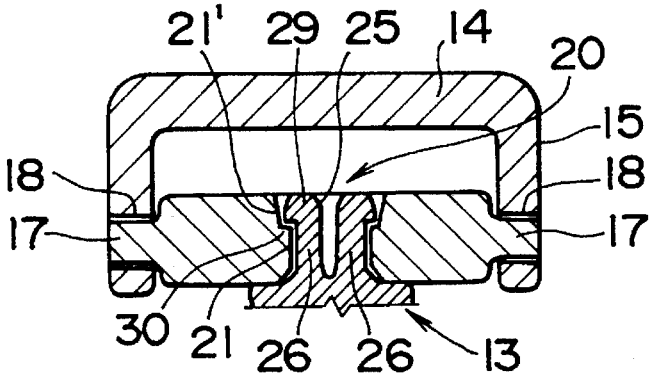
FIG. 3 is a fragmentary cross-sectional view of a male coupling member the buckle of FIG. 1.
Figure 4:
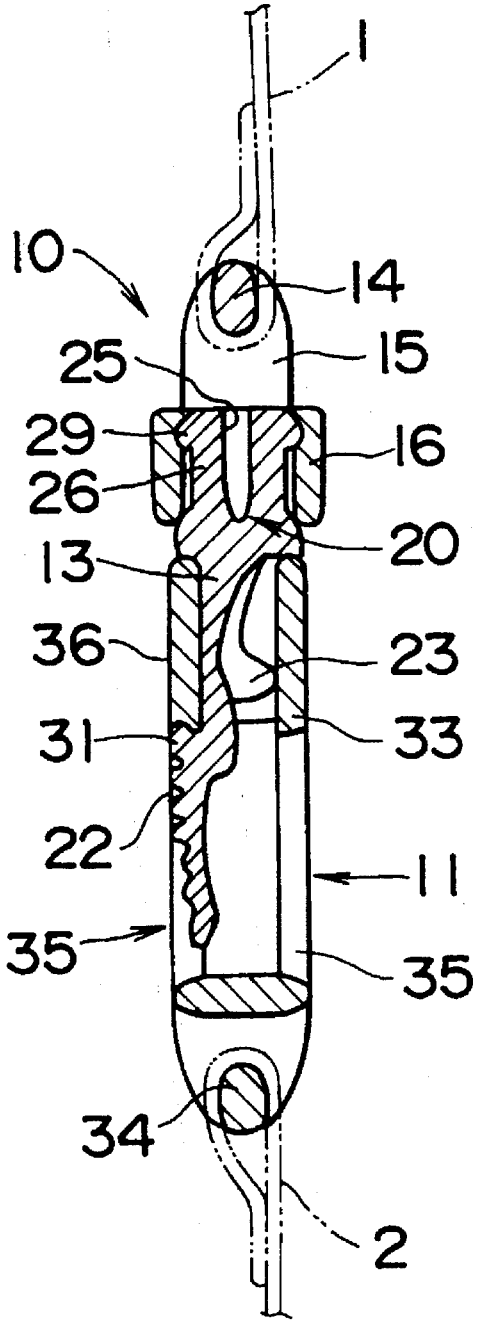
FIG. 4 is a cross-sectional view taken on the line A—A of FIG. 1.

As better shown in FIG. 1, the male coupling member 10 is generally comprised of a rectangular belt-attaching frame 12 and a locking member 13 rotatably joined to the belt-attaching frame 12 and adapted to be inserted into the female coupling member 11. The rectangular belt-attaching frame 12 is composed of a pair of side bars 15, 15, and a belt-attaching bar 14 joined at its opposed ends to the respective upper ends of the side bars 15, 15. Each side bar 15 has a through hole 18 formed therethrough adjacent to the lower end and disposed in coaxial relation to the matching hole 18 of the other side bar 15. The frame 12 also includes a proximal bar 16 which has a pair of coaxial terminal axles 17, 17 formed on the opposed ends of the proximal bar 16. The proximal bar 16 is rotatably mounted on the side bars 15, 15 by fitting the terminal axles 17, 17 into the through holes 18, 18. The proximal bar 16 has a central through hole 21 formed centrally through the proximal bar 16 and a countersink 21' formed in the top of the hole 21 to thus provide an annular shoulder 30 in the through hole 21. The locking member 13 comprises a base flange **13*a*, a joint portion 20 mounted centrally on the upper surface of the base flange 13*a*, a locking bar 13*b* mounted centrally on the lower surface of the base flange 13*a* and a pair of resilient crooked arms 23, 23 mounted on the lower surface of the base flange 13*a* and disposed on the opposed sides of the locking bar 13*b*. As shown in FIGS. 1 and 3, the joint portion 20 is comprised of four juxtaposed sections 26 separated by two cross-cut grooves 25. These sections 26 have the respective enlarged heads 29 formed on their tops so as to spread radially outward. As better shown in FIG. 1, the locking bar 13*b* has a circular locking disk or button 22 formed on the distal end of the upper surface thereof. The circular locking button 22 is formed at an angle relative to the locking bar 13***b* to thus provide a concave locking edge 31 on that part of the periphery of the circular locking button 22 which is closer to the joint portion 20. The locking edge 31 has a predetermined curvature and is tapered down.

As better shown in FIG. 1, the female coupling member 11 is generally comprised of a housing body 33 and a belt-attaching bar 34 provided on the housing body 33. The housing body 33 includes a pair of parallel spaced upper and lower plates 33*a*, 33*b* and a pair of side plates 33*c*, 33*c* each connected at its opposed edges with the relevant edges of the upper and lower plates 33*a*, 33*b* to define a chamber 32 there between. The upper and lower plates 33*a*, 33*b* extend forward beyond the side plates 33*c* and terminate in the respective arcuate front edges 32*e*, 32*e*. The respective front edges 32*e*, 32*e* of the upper and lower plates 32*a*, 32*b* and the side plates 33*c*, 33*c* jointly define a front opening 32*a* which communicates with the chamber 32. A pair of coaxial circular apertures 35, 35 are formed centrally in the upper and lower plates 33*a*, 33*b*, respectively. The inner diameter of each circular aperture 35 is slightly greater than the outer diameter of the locking button 22. A concave locking indentation 36 is formed in that part of the periphery of each aperture 35 which is close to the opening 32*a*. The curvature of the locking edge 31 of the locking button 22 is equal to that of the concave locking indentation 36. The locking indentation 35 is also tapered at an angle which is complementary to the angle of the locking edge 31. Consequently, when the locking button 22 of the male coupling member 10 comes into locking engagement with the locking aperture 35 of the female coupling member 11, the locking edge 31 of the locking button 22 comes into surface-to-surface contact with the locking indentation 36. The side plates 33*c*, 33*c* extend rearward beyond the lower edges of the upper and lower plates 33*a*, 33*b* to provide opposed extensions 33*d*, 33*d*. The belt-attaching bar 34 is mounted between the opposed extensions 33*d*, 33*d*.

To couple the male coupling member 10 with the female coupling member 11, the locking bar 13 of the male coupling member 10 is inserted through the opening 32*a* into the chamber 32 of the female coupling member 11. As the locking bar 13 advances in the chamber 32, the resilient crooked arms 23, 23 contact the lower plate 33*b*, so that the locking button 22 is biased into sliding engagement with the inner surface of the upper plate 33*a* under resilience of the resilient crooked arms 23, 23. As soon as the locking edge 31 reaches the locking indentation 36, the locking button 22 snaps into the locking aperture 35 and the locking edge 31 comes into locking engagement with the locking indentation 36. As a result, the male coupling member 10 is coupled with the female coupling member 11.

Figure 2:
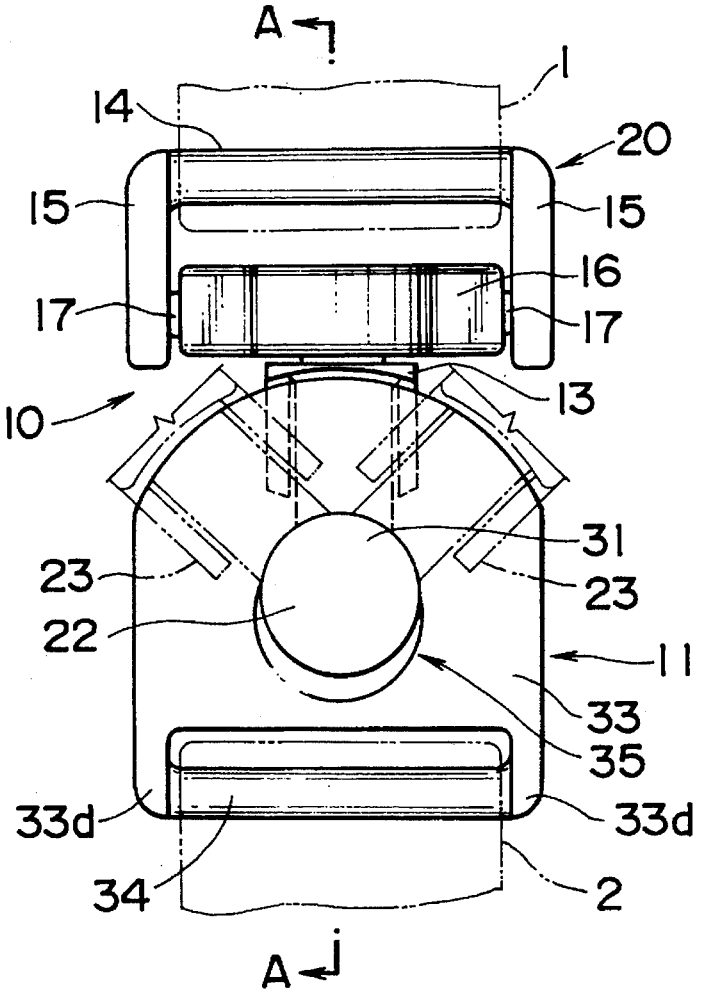
FIG. 2 is a front view of the buckle of FIG. 1, showing the buckle attached to a belt.

In such a coupled disposition, the male coupling member 10 can be rotated on the female coupling member 11 around the aperture 35 in the plane of the buckle to the extent which the width of the opening 32*a* permits, as indicated in phantom lines in FIG. 2. The belt-attaching frame 12 can also be rotated on the locking member 13 around the joint portion 20 in the direction perpendicular to the plane of the buckle. The belt-attaching bar 14 can be rotated on the proximal bar 16 around the terminal axles 17, 17 in the direction perpendicular to the plane of the buckle and also perpendicular to the axis of the locking member 13. When all these aspects have been considered, the male coupling member 10 and the female coupling member 11 can be rotated relative to each other on three different axes which are perpendicular to one another.

For uncoupling the male coupling member 10 from the female coupling member 11, the locking button 22 is depressed in order to disengage from the locking aperture 35 and enter the chamber 32, thereby bringing the locking edge 31 of the locking button 22 out of locking engagement with the locking indentation 36 of the locking aperture 35. Now that the locking edge 31 of the locking button 35 has come out of locking engagement with the locking indentation 36 of the locking aperture 35, the locking member 13 of the male coupling member 10 can be pulled out of the chamber 32 of the female coupling member 11 with great ease.

With the construction of the first embodiment set forth above, the male coupling member 10 can be rotated on the female coupling member on the three different axes which are perpendicular to each other, therefore, the buckle can absorb possible stresses exerted on the buckle and the belt in all directions. Furthermore, since the identical locking through apertures 35 are formed in both upper and lower plates 33*a*, 33*b*, a wearer can simply insert the male coupling member 10 into the female coupling member 11 with no regard to which the upper plate 33*a* is. This is very advantageous when using this buckle.

Furthermore, when the male coupling member 10 and the female coupling member 11 are coupled, the locking edge 31 of the locking button 22 is in surface-to-surface contact with the indentation 36 of the locking aperture 35. As a result, the locking button 22 can be coupled with the locking aperture 35 more firmly. Furthermore, the locking button 22 and the locking aperture 35 are less liable to damages caused by the frequent rotation of the former on the latter and to damages as a result of heavy tension exerted on the buckle.

Figure 5:
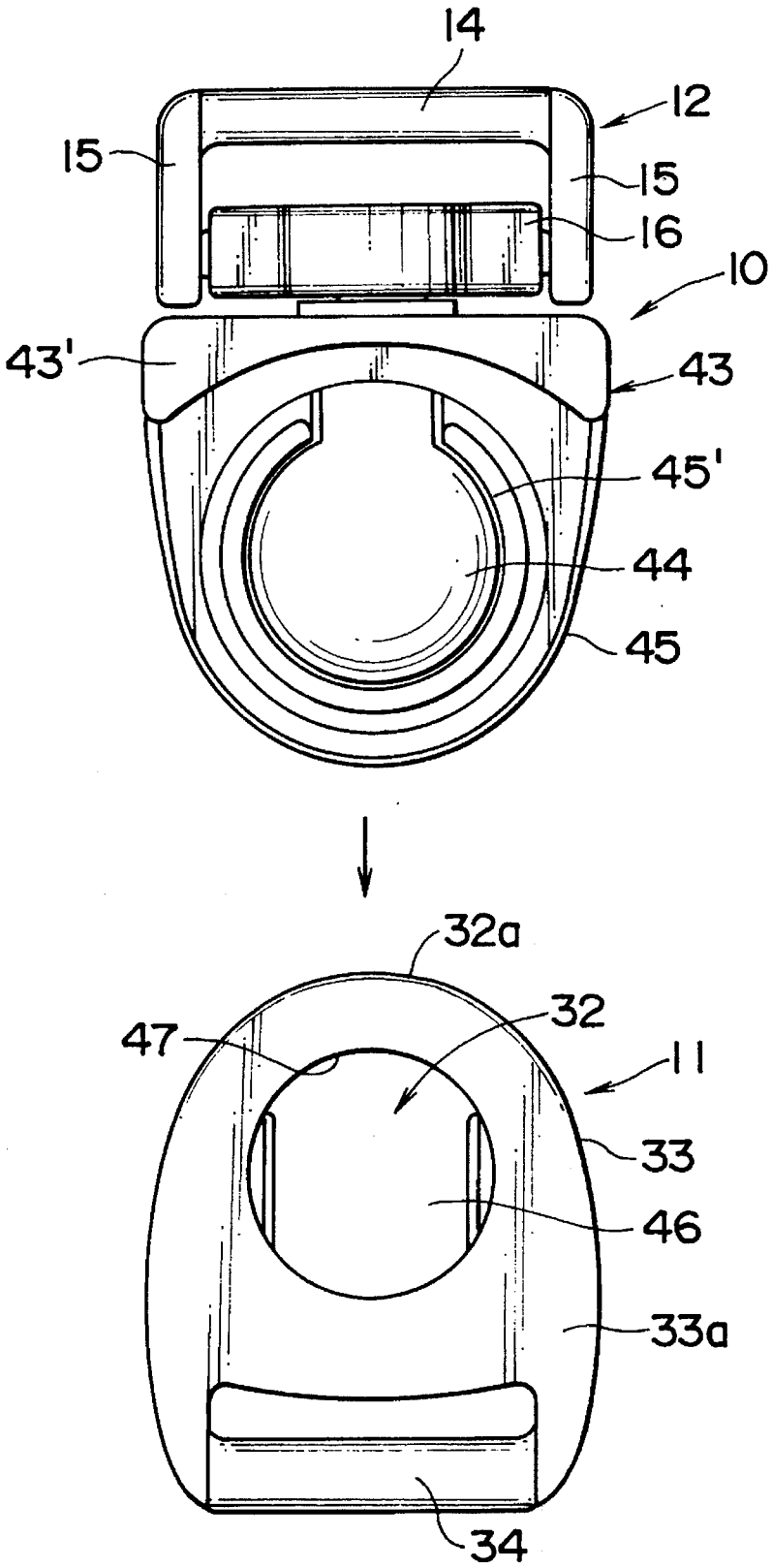
FIG. 5 is a front view of a buckle according to the second embodiment of the present invention, showing a male coupling member and a female coupling member of the buckle in uncoupled disposition.
Figure 6:
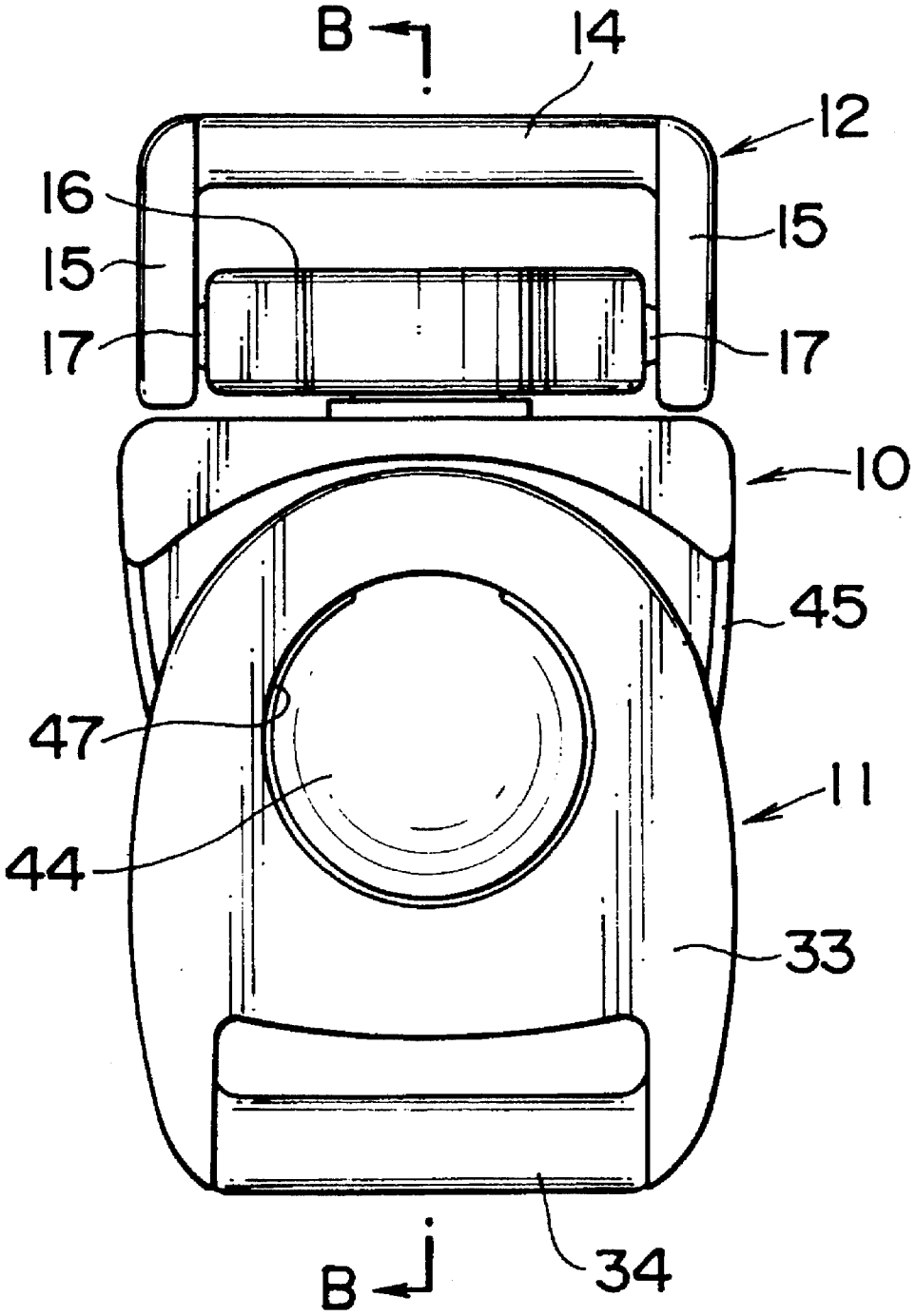
FIG. 6 is a front view of the buckle of FIG. 5, showing the male coupling member and the female coupling member in coupled disposition.
Figure 7:
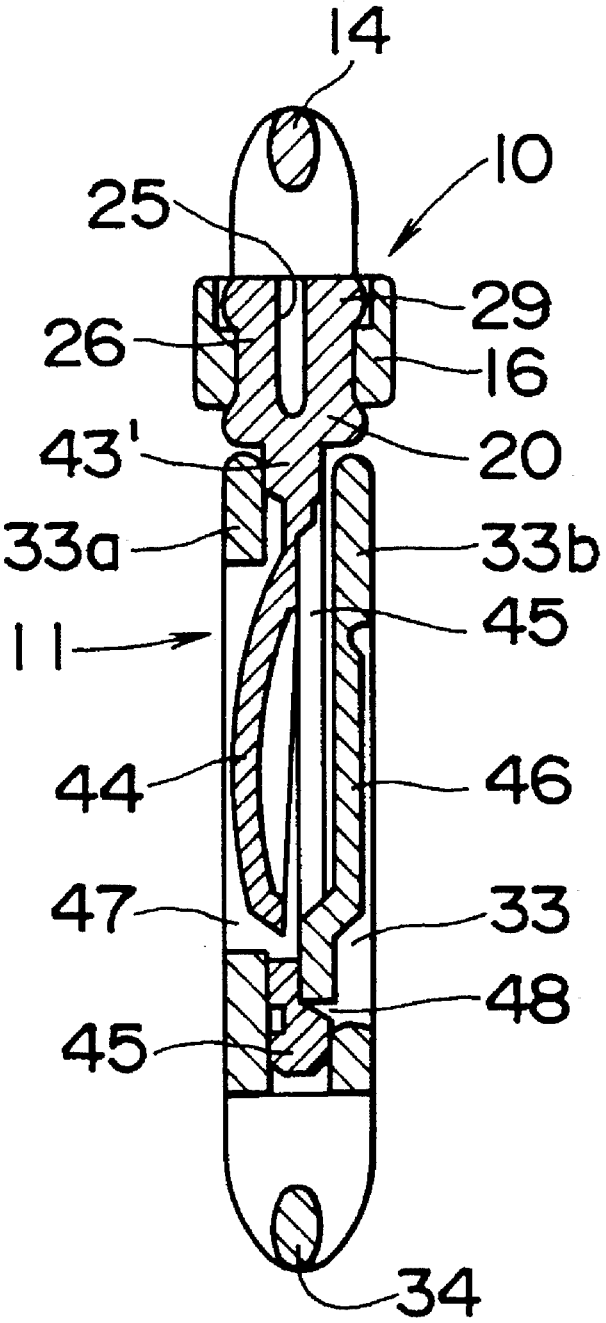
FIG. 7 is a cross-sectional view taken on the line B—B of FIG. 5.

Referring now to the second embodiment of the present invention in conjunction with FIGS. 5 through 7. The same reference numerals are used on the same parts as in the preceding embodiment, for brevity.

According to the second embodiment, as shown in FIG. 5, the locking member 43 comprises a base bar 43', an annular insert plate 45 and a central circular button 44 both integrally mounted on the base bar 43. The annular insert plate 45 extends forward from the base bar 43 and the central locking disk-like button 44 also extends forward from the base bar 43 and disposed in a substantially circular hole 45' defined by the annular insert plate 45. The annular insert plate 45 and the central locking button 44 are cantilevered on the base bar 43 and are resilient independent of each other. As better shown in FIG. 7, the annular insert plate 45 has a locking step 48 on the outer periphery of the front end on the lower surface.

The female coupling member 11 has a circular locking aperture 47 formed centrally of the upper plate 33*a*. A resilient locking tongue 46 is cut in the lower plate 33*b* so as to extend from the lower plate 33*b* adjacent to the opening 32*a* and project slantly upward into the chamber 32, as shown in FIG. 7, so that the locking tongue 46 is cantilevered on the lower plate 33*b*. The size and shape of the front end of the resilient locking tongue 46 is formed in such a way as to come into locking engagement with the locking step 48 of the annular insert plate 45. The circular locking aperture 47 is slightly greater in diameter than the circular locking button 44. The circular locking button 44 comes into fitting engagement with the locking aperture 47 when the locking member 43 of the male coupling member 12 is inserted into the chamber 32 of the female coupling member 11.

Figure 8:
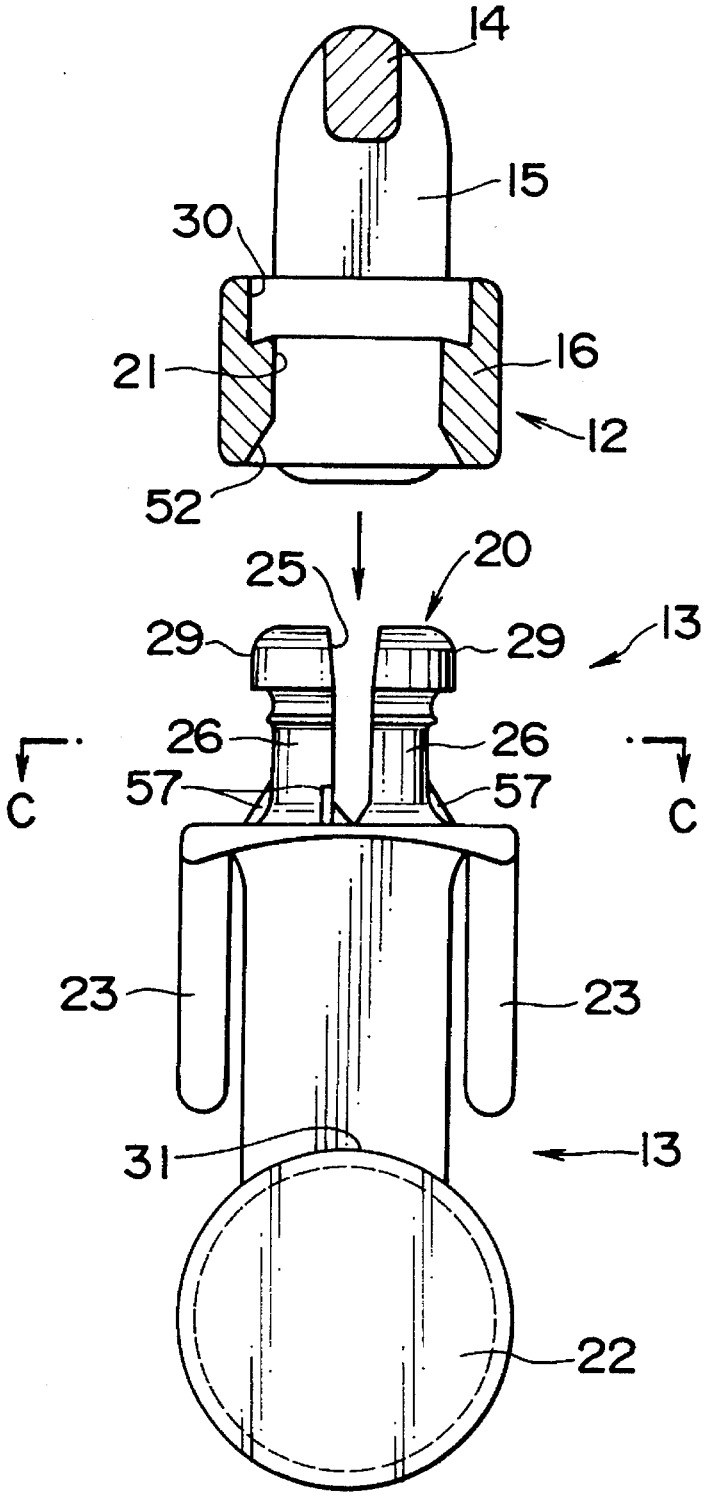
FIG. 8 is a front view, partly cross-sectional, of a male coupling member of a buckle according to the third embodiment of the present invention.
Figure 9:
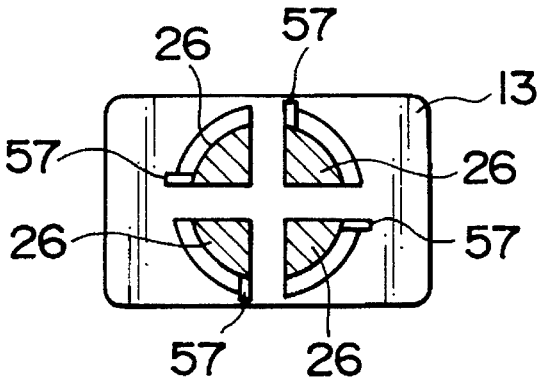
FIG. 9 is a cross-sectional view taken on line C—C of FIG. 8.

FIGS. 8 and 9 show the third embodiment of the present invention. The same reference numerals are used on the same parts as in the preceding embodiments. The third embodiment is substantially identical with the first embodiment except for the construction of the joint portion 20 and the through hole 21. To be specific, each joint section 26 has a resilient buttress 57 formed at its lower end and disposed on the outer periphery of the joint portion 20. The through hole 21 is enlarged on the lower end to provide a lower countersink 52. The inner diameter of the lower countersink 52 is slightly smaller than the distance between the two diametrically opposed buttresses 57, 57. When the joint portion 20 is inserted into the through hole 21, the resilient buttresses 57 are forced into the lower countersink 52 against their own resiliency. The resilient engagement of the buttresses 57 with the countersink 52 helps to engage the joint portion 20 with the through hole 21 firmly without rattling therebetween.

Figure 10:
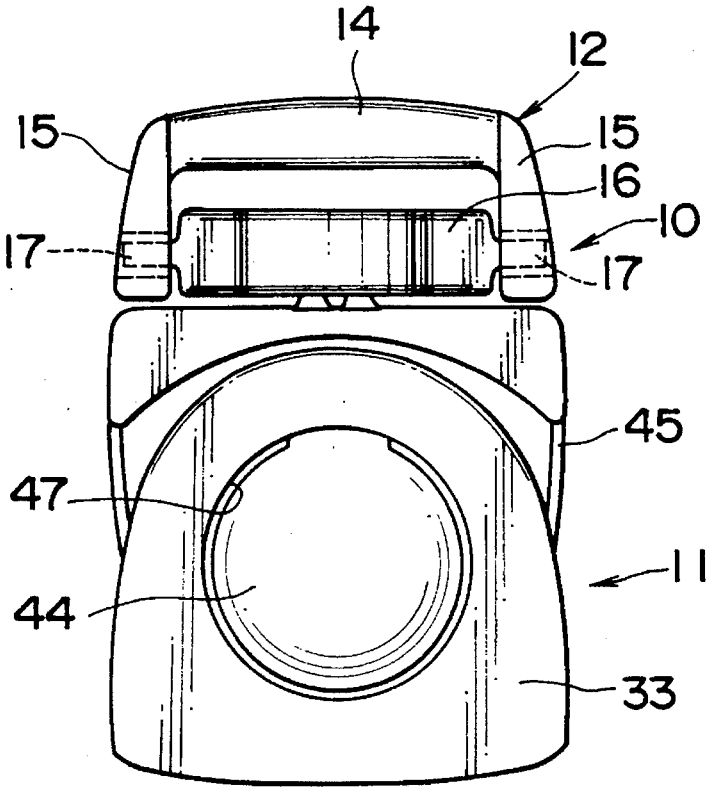
FIG. 10 is a front view of a buckle according to the fourth embodiment of the present invention, showing the male and female coupling members in coupled disposition.
Figure 11:
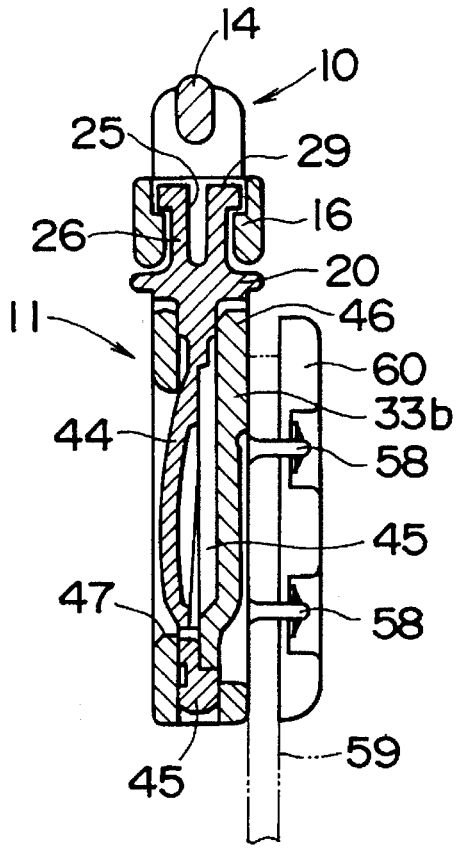
FIG. 11 is a central cross-sectional view of the buckle of FIG. 10.

Turning now to the fourth embodiment of the present invention in conjunction with FIGS. 10 and 11. A buckle according to the fourth embodiment is substantially identical to that according to the first embodiment with the exception that the female coupling member 11 is not attached to an end of a belt but a fabric strip constituting a bag, pouch or the like. Instead of a belt-attaching bar, the female coupling member 11 has a number of attaching legs 58 mounted on the lower plate 33*b*—only two illustrated in FIG. 11. In addition, a back plate 60 is provided. The back plate 60 has a number of through holes formed. The female coupling member 11 is fastened to a fabric strip 59 by piercing the attaching legs 58 through the fabric strip 59 and the though holes of the back plate 60 and clinching the legs 58 against the back plate 60.

Figure 12:
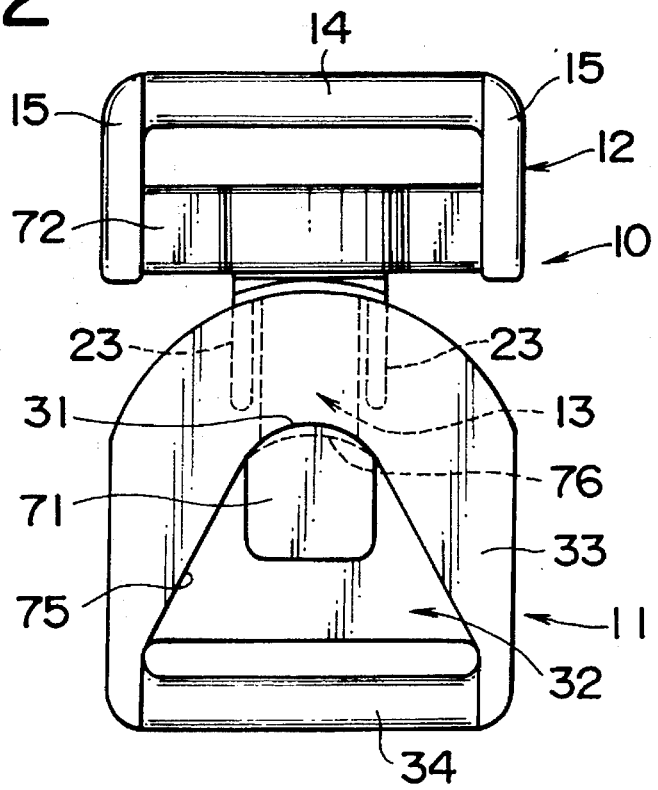
FIG. 12 is a front view of a buckle according to the fifth embodiment of the present invention.

FIG. 12 shows a buckle according to the fifth embodiment of the present invention. The proximal bar 72 is fixedly attached to the side bars 15, 15. The locking button 71 is not a circular disk but a substantially square. However, the locking button 71, likewise, has an convex locking edge 31 formed in that portion of the edge which is closer to the belt-attaching frame 12. The convex locking edge 31 has a predetermined curvature. The convex edge 31 is tapered downward.

The locking aperture 75 is substantially triangular and so much larger than the circular aperture 35 according to the first embodiment and extends as far as the belt-attaching bar 34. The apex corner of the triangle is concave at the same curvature as the convex locking edge 31 to provide a locking indentation 76. The locking indentation 76 is so tapered as to be complementary with the taper of the convex edge 31 so that the locking concave indentation 76 comes into surface-to-surface contact with the convex edge 31.

With the construction of the present invention set forth above, since the male coupling member can be rotated on the female coupling member on the three different axes which are perpendicular to each other, the buckle can absorb possible stresses exerted on the buckle and the belt in all directions. Furthermore, since the identical locking through apertures are formed in both upper and lower plates, a wearer can simply insert the male coupling member into the female coupling member with no regard as to which the upper plate is. This is very advantageous when using this buckle.

Furthermore, when the male coupling member and the female coupling member are coupled, the locking edge of the locking button is in surface-to-surface contact with the indentation. As a result, the locking button can be coupled with the locking aperture more firmly. Furthermore, the locking button and the locking aperture are less liable to damages caused by the frequent rotation of the former on the latter and to damage as a result of heavy tension exerted on the buckle.

In the foregoing description, and in the claims which follow, terms like "upper", "lower", "upward", "front" and so forth presuppose, a certain orientation of each buckle, but are not to be interpreted to mean that the buckle has to be in that orientation, only that it is capable of so being.

Obviously, various modifications and variations of the present invention are possible in the light of the above teaching. It is therefore to be understood that within the scope of the appended claims the invention may be practiced otherwise than as specifically described.

What is claimed is:

1. A buckle, comprising:

a male coupling member; and a female coupling member;

the male coupling member including an article-attaching frame having a pair of side bars, an article-attaching bar joined to the side bars and a proximal bar joined to respective lower ends of the side bars so as to rotate on its own axis and a locking member including a joint portion integrally mounted on the upper end thereof and mounted on the proximal bar so as to rotate on the axis of the locking member which is substantially perpendicular to the axis of the proximal bar;

the female coupling member including a housing body and an article-attaching portion provided on the housing body, the housing body comprising a pair of upper and lower plates joined to each other to define a chamber therebetween, respective front edges of the upper and lower plates defining a front opening therebetween which communicate with the chamber; and means for locking and guiding the locking member into the housing body so as to rotate on the housing body around the axis which is perpendicular to the plane of the buckle.

2. A buckle according to claim 1, the upper plate having a circular locking aperture formed there through, said locking means comprising a circular locking button formed at the lower end of the locking member for interlocking engagement with the circular locking aperture, when the locking member is inserted into the housing chamber through the front opening.

3. A buckle according to claim 2, the circular locking button having a convex locking edge on that part of the periphery which is closer to the joint portion; the circular locking aperture having a concave locking indentation formed in that part of the periphery which is closer to the opening, the convex locking edge of the locking bottom being sized for locking engagement with the concave locking indentation of the locking aperture, the curvature of the locking edge of the locking button being equal to the curvature of the concave locking indentation.

4. A buckle according to claim 3, the concave locking edge of the locking button being tapered down; the locking indentation of the locking aperture being tapered at an angle which is complementary to the angle of the locking edge of the locking button.

5. A buckle according to claim 1, the locking member including a base bar, the upper plate having a circular locking aperture formed there through, the lower plate having a resilient locking tongue formed thereon so as to extend from the lower plate adjacent to the opening and project slantly upward into the chamber, the locking means comprising a central circular button and an annular insert plate both integrally mounted on the base bar; the annular insert plate extending forward from the base bar and the central locking button also extending forward from the base bar and disposed in substantially circular hole defined by the annular insert plate, the annular insert plate and the central locking button being cantilevered on the base bar and being resilient independent of each other, the annular insert plate having a locking step on the front end of the lower surface; the circular locking aperture being slightly greater in diameter than the circular locking button, the circular button and the locking step of the annular insert plate coming into engagement with the locking aperture and the front end of the resilient locking tongue, respectively, when the locking member of the male coupling member is inserted into the chamber of the female coupling member.

6. A buckle, comprising:

a male coupling member; and a female coupling member;

the male coupling member including an article-attaching frame and a locking member including a locking bar, a joint portion integrally mounted on the upper end of the locking bar and mounted on the article-attaching frame so as to rotate on the axis of the locking member and a locking button mounted on a lower end of the locking bar, the locking button having a convex edge formed on that part of its periphery which is closer to the joint portion, the female member including a housing body and an article-attaching portion provided on the housing body, the housing body comprising a pair of upper and lower plates jointed to each other to define a chamber therebetween, respective front edge of the upper and lower plates defining a front opening therebetween which communicate with the chamber, the upper plate having an aperture formed therein, the aperture having a concave indentation formed on that part of its periphery which is closer to the opening, the concave indentation being equal in curvature to the convex edge of the locking button, upon insertion of the locking member into the housing body, the convex edge of the locking button coming into locking engagement with the concave indentation of the locking aperture, the aperture guiding the locking button for rotary movement about an axis perpendicular to the plane of the upper plate.

7. A buckle according to claim 6, the concave locking edge of the locking button being tapered down; the locking indentation of the locking aperture being tapered at an angle which is complementary to the angle of the locking edge of the locking button.

* * * * *